US012404635B2

(12) United States Patent
Mattingly et al.

(10) Patent No.: US 12,404,635 B2
(45) Date of Patent: Sep. 2, 2025

(54) WATER RESISTANT MATERIALS FOR FOOD-SAFE USES

(71) Applicant: JL Darling LLC, Tacoma, WA (US)

(72) Inventors: John T. Mattingly, Fox Island, WA (US); Paul Snowwhite, Dexter, MI (US)

(73) Assignee: JL Darling LLC, Tacoma, WA (US)

( * ) Notice: Subject to any disclaimer, the term of this patent is extended or adjusted under 35 U.S.C. 154(b) by 1021 days.

(21) Appl. No.: 17/161,598

(22) Filed: Jan. 28, 2021

(65) Prior Publication Data

US 2021/0246614 A1 Aug. 12, 2021

Related U.S. Application Data

(60) Provisional application No. 62/968,666, filed on Jan. 31, 2020.

(51) Int. Cl.

| | |
|---|---|
| ***D21H 21/16*** | (2006.01) |
| ***A47G 19/03*** | (2006.01) |
| ***A47G 21/18*** | (2006.01) |
| ***D21H 17/60*** | (2006.01) |
| ***D21H 19/18*** | (2006.01) |
| ***D21H 19/22*** | (2006.01) |
| ***D21H 19/32*** | (2006.01) |

(52) U.S. Cl.

CPC ..... *D21H 21/16* (2013.01); *A47G 19/03* (2013.01); *A47G 21/18* (2013.01); *D21H 17/60* (2013.01); *D21H 19/18* (2013.01); *D21H 19/22* (2013.01); *D21H 19/32* (2013.01)

(58) Field of Classification Search

CPC ..... D21H 21/16; D21H 17/60; D21H 19/18; D21H 19/22; D21H 19/32; A47G 19/03; A47G 21/18

See application file for complete search history.

(56) References Cited

U.S. PATENT DOCUMENTS

| | | | | |
|---|---|---|---|---|
| 2,027,390 A | | 1/1936 | Lazier et al. | |
| 4,217,395 A | * | 8/1980 | Kuan | C08J 7/043 156/289 |
| 4,567,221 A | * | 1/1986 | Maruyama | C09K 3/18 525/61 |
| 5,928,741 A | | 7/1999 | Andersen et al. | |

(Continued)

FOREIGN PATENT DOCUMENTS

| | | | |
|---|---|---|---|
| CN | 107366193 A | * | 11/2017 |
| EP | 0 939 848 B1 | | 5/2004 |

(Continued)

OTHER PUBLICATIONS

Vibhore Kumar Rastogi, Bio-Based Coatings for Paper Applications, 2015, MDPI, 887-902 (Year: 2015).*

(Continued)

*Primary Examiner* — Jacob T Minskey
*Assistant Examiner* — Stephen M Russell
(74) *Attorney, Agent, or Firm* — Seed IP Law Group LLP

(57) ABSTRACT

The present disclosure relates to food safe water resistant articles, which include recyclable cellulosic utensils having a food safe water resistant material. In addition, food safe water resistant composition used for preparing food safe water resistant articles as well as use of the same are also disclosed.

18 Claims, 6 Drawing Sheets

(56) References Cited

U.S. PATENT DOCUMENTS

| | | | | |
|---|---|---|---|---|
| 6,844,081 | B2 | 1/2005 | Hart et al. | |
| 8,137,818 | B2 | 3/2012 | Harrison et al. | |
| 8,361,278 | B2 | 1/2013 | Fike et al. | |
| 8,480,851 | B2 | 7/2013 | Zhou | |
| 9,956,741 | B2 | 5/2018 | Planchard | |
| 2004/0214943 | A1 | 10/2004 | Hager et al. | |
| 2007/0292643 | A1* | 12/2007 | Renn | B65D 25/34 428/34.1 |
| 2009/0074971 | A1* | 3/2009 | McMahon | D06M 16/00 427/314 |
| 2016/0348318 | A1* | 12/2016 | Koenig | D21H 19/54 |
| 2018/0094165 | A1 | 4/2018 | Yoon | |
| 2018/0265729 | A1* | 9/2018 | Gibanel | C08F 2/24 |
| 2018/0282947 | A1 | 10/2018 | Mattingly et al. | |

FOREIGN PATENT DOCUMENTS

| | | | |
|---|---|---|---|
| WO | 01/72923 | A1 | 10/2001 |
| WO | 2012/064558 | A1 | 5/2012 |
| WO | 2019/050953 | A1 | 3/2019 |

OTHER PUBLICATIONS

Adenekan, Kolawole, "Hydrophobization of Cellulose-Based Fibers for Packaging Applications with Alkyl Ketene Dimers (AKD) and Food-Grade Waxes via Supercritical Impregnation with Carbon Dioxide—Experimental and Thermodynamic Modeling Approaches," *Electronic Theses and Dissertations 1527*, https://egrove.olemiss.edu/etd/1527, May 2019. (9 pages).

* cited by examiner

WATER RESISTANT MATERIALS FOR FOOD-SAFE USES

BACKGROUND

Technical Field

The present disclosure is directed to water or moisture-resistant paper or paper-containing substrates safe for use as food and beverage containers and utensils, as well as preparation and use of the same.

Background

Various methods are known for treating paper and paper containing materials to impart liquid-repellant or liquid-proof properties. A number of the known methods for treating paper to render it more water-repellent use paper sizing or surface sizing. Various compositions have been described as suitable for surface sizing but are limited with respect to their ability to produce paper that is sufficiently water-repellant or waterproof so as to remain intact and legible when wet.

There remains a need in the art for a cellulosic composition (e.g., paper) that is weatherproof and is safe for use with food and beverages. In addition, a need exists for such a composition that can be easily written on with a pen or pencil, can be re-pulped and recycled, and is compatible with a wide variety paper stocks (particularly recycled stock). Finally, there remains a need in the art for compositions and methods that can provide paper having the above-described properties with water-based materials (i.e., environmentally friendly chemicals) capable of imparting the requisite water resistance and wet strength. The present disclosure fulfills these needs and provides further related advantages.

BRIEF DESCRIPTION

Generally, the present disclosure relates to food safe water resistant material in combination with paper or a paper containing material(s). Accordingly, one embodiment provides a food safe article comprising a substrate comprising a plurality of cellulose fibers, and a food safe water resistant material, wherein the food safe water resistant material impregnantly covers at least a portion of a surface of the substrate.

Another embodiment provides use of a food safe article for consuming, serving, transporting, storing, or disposing of food wherein the food safe article comprises a substrate comprising a plurality of cellulose fibers, and a food safe water resistant material, wherein the food safe water resistant material impregnantly covering at least a portion of a surface of the substrate.

Yet another embodiment provides a method for preparing a food safe article, the method comprising:

i. providing an article comprising a plurality of cellulose fibers; and ii. contacting the article with a food safe resistant composition thereby forming a food safe water resistant material, wherein the food safe water resistant material impregnantly covering at least a portion of a surface of the substrate.

These and other aspects of this disclosure will be evident upon reference to the following detailed description of the disclosure.

BRIEF DESCRIPTION OF THE DRAWINGS

In the figures, identical reference numbers identify similar elements or acts. The sizes and relative positions of elements in the figures are not necessarily drawn to scale. For example, the shapes of various elements and angles are not drawn to scale and some of these elements are enlarged and positioned to improve figure legibility. Further, the particular shapes of the elements as drawn, are not intended to convey any information regarding the actual shape of the particular elements, and have been solely selected for ease of recognition in the figures.

DETAILED DESCRIPTION

Figure 1:
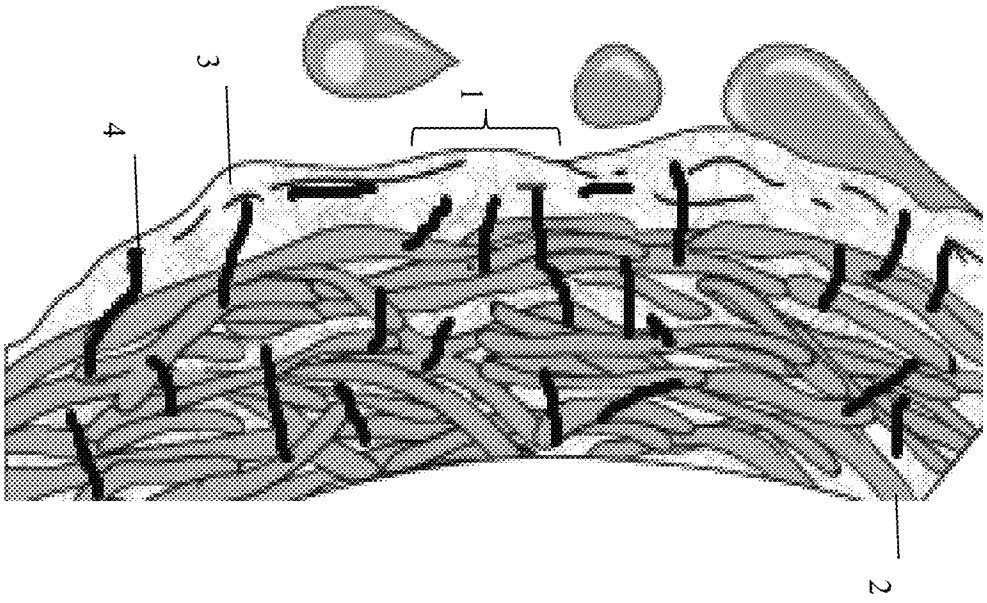
FIG. 1 is an example illustration showing a substrate comprising a plurality of cellulose fibers and a food safe water resistant material impregnantly covering a surface of the substrate.

Food safe water/moisture resistant or water/moisture proof paper or paper-containing substrates, as well as preparation and use thereof, are disclosed herein below. The particulars described herein are by way of example and are only for purposes of illustrative discussion of embodiments of the present disclosure. The use of any and all examples, or exemplary language (e.g., "such as" or "for example") provided herein is merely intended to better illuminate the disclosure and does not pose a limitation on the scope of the disclosure as claimed. No language in the specification should be construed as indicating any non-claimed element is essential to the practice of the disclosure. Further, all methods described herein can be performed in any suitable order unless otherwise indicated herein or otherwise clearly contradicted by context.

The use of the alternative (e.g., "or") should be understood to mean one, both, or any combination thereof of the alternatives. The various embodiments described above can be combined to provide further embodiments. Groupings of alternative elements or embodiments of the disclosure described herein should not be construed as limitations. Each member of a group may be referred to and claimed individually, or in any combination with other members of the group or other elements found herein.

Each embodiment disclosed herein can comprise, consist essentially of, or consist of a particular stated element, step, ingredient, or component. As used herein, the term "comprise" or "comprises" means "includes, but is not limited to," and allows for the inclusion of unspecified elements, steps, ingredients, or components, even in major amounts. As used herein, the phrase "consisting of" excludes any element, step, ingredient, or component that is not specified. As used herein, the phrase "consisting essentially of" limits the scope of the embodiment to the specified elements, steps, ingredients, or components, and to those that do not materially affect the basic and novel characteristics of the claimed disclosure.

The terms "a," "an," "the," and similar articles or terms used in the context of describing the disclosure (especially in the context of the following claims) are to be construed to cover both the singular and the plural (i.e., "one or more"), unless otherwise indicated herein or clearly contradicted by context. Ranges of values recited herein are intended to serve as a shorthand method of referring individually to each separate value falling within the range. In the present description, any concentration range, percentage range, ratio range, or integer range is to be understood to include the value of any integer within the recited range and, when appropriate, fractions thereof (such as one tenth and one hundredth of an integer), unless otherwise indicated. Also, any number range recited herein relating to any physical feature, such as size or thickness, are to be understood to include any integer within the recited range, unless otherwise indicated. Unless otherwise indicated herein, each individual value is incorporated into the specification as if it were individually recited herein.

The term "about" has the meaning reasonably ascribed to it by a person of ordinary skill in the art when used in conjunction with a stated numerical value or range, i.e., denoting somewhat more or somewhat less than the stated value or range, to within a range of +20% of the stated value; ±19% of the stated value; ±18% of the stated value; ±17% of the stated value; +16% of the stated value; ±15% of the stated value; #14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

A. Food Safe Water Resistant Material

Definitions used in the present disclosure are meant and intended to be controlling in any future construction unless clearly and unambiguously modified in the examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art.

"Food safe" refers to an article or coating that complies with government regulations related to food safety. For example, "food safe" includes, but is not limited to, an article or coating that comply with regulations of the U.S. Food and Drug Administration ("USFDA"), the U.S. Drug administration ("USDA"), European Food Safety Authority ("EFSA"), the China Food and Drug Administration ("CFDA"), the Canadian Food Inspection Agency, and the like. "Food safe" may include compliance with Title 21 of the Code of Federal Regulations (e.g., 21 CFR §§ 174.5-178.3950)

The term "water resistant" refers to a material's ability to resist the penetration of water to some degree, despite prolonged exposure to moisture or a wet environment. More specifically, this means that the food safe article resists falling apart when wet and also maintains a substantially intact and undisturbed form. The water resistant character of the food safe article is largely a function of water repellency and wet strength. Water repellency refers to the ability of the food safe article to resist wetting (i.e., invasion of water or moisture into the matrix of cellulose fibers of the article through capillary action).

"Impregnantly" refers to a physical blend of elements, materials, polymers, and/or fibers that is substantially homogenous. That is, in certain embodiments, a food safe water resistant material "impregnantly" covering a surface means the food safe water resistant material is substantially dispersed throughout that surface and is not limited to a layer (e.g., a coating layer) separate from and on top of that surface (i.e., the food safe water resistant material penetrates the surface to at least some degree). In some embodiments, "impregnantly" means the food safe water resistant material substantially saturates and/or permeates the surface of the substrate and is intermingled throughout the cellulose fibers of a surface of the substrate.

Figure 2A:
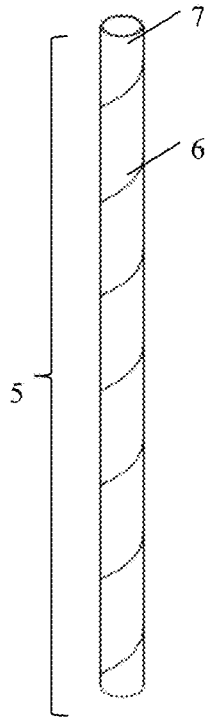
FIG. 2A shows a straw as an exemplary water resistant article.
Figure 2B:
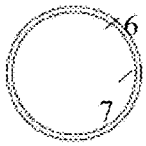
FIG. 2B shows an internal surface and an external surface of a water resistant straw of FIG. 2A.

As used herein, "article" or "food safe article" is an object used for consumption, service, transport, storage, and/or disposal of food or food related goods (e.g., condiments, seasoning, sauces, colorants, additives, etc.). In some embodiments, a "food safe article" may include a dish, plate, bowl, cutlery, placemat, coaster, straw (see, e.g., FIGS. 2A-2C), cup (see, e.g., FIG. 3A), cup lid (FIG. 3B) platter, mug, canteen, cruet, napkin ring, napkin, bib, crockery, fork, spoon, knife, basket, wrapper, jar, can, liner, bag, container (see, e.g., FIGS. 4 and 5), container lid, canister, box, bottle, cover, saucer, basin, bin, bucket, tray, jug, ladle, packaging, insert, carrier, sack, cooler, warmer, table cloth, carafe, flask, decanter, pitcher, funnel, cutting board, pot, vessel, urn, ewer, spork, packet, pouch, carton, and the like.

"Wet strength" refers to the tensile strength of an article when permeated or soaked with water, the strength being provided by bond between the components of the system (e.g., inter-fiber bonds, fiber-fiber cross-links, fiber-polymer cross-links, polymer-polymer cross-links, etc.) having resistance to attack by water. Without wishing to be bound by theory, strength is believed to be related to entanglement of fibers as well as addition of natural polymers and synthetic resin to pulp slurry during the manufacturing process, which creates a resistance to swelling, protects existing fiber bonds and forms new water resistant bonds. Wet strength can be determined by Tappi Test Method T456 and is routinely expressed as the ratio of wet to dry tensile force at break. Wet strength can be measured as the peak tensile force (in Newtons) at breakage for an article soaked in distilled water for a controlled period of time (e.g., 5 minutes; referred to as "wet strength method").

In one embodiment, a food safe article comprising a substrate comprising a plurality of cellulose fibers, and a food safe water resistant material, wherein the food safe water resistant material impregnantly covers at least a portion of a surface of the substrate is presented. In certain embodiments, the food safe article comprises at least one cross-link between two or more components (e.g., cellulose fibers, polymers, and combinations thereof).

In some embodiments, the food safe article has a wet strength greater than 0 Newtons. In some more specific embodiments, the food safe article has a wet strength greater than 100 Newtons. In some embodiments, the food safe article has a wet strength greater than 200 Newtons, greater than 300 Newtons, greater than 400 Newtons, greater than 500 Newtons, greater than 600 Newtons, greater than 700 Newtons, greater than 800 Newtons, greater than 900 Newtons, greater than 1,000 Newtons, greater than 1,100 Newtons, greater than 1,200 Newtons, greater than 1,300 Newtons, greater than 1,400 Newtons, greater than 1,500 Newtons, greater than 1,600 Newtons, greater than 1,700

Newtons, greater than 1,800 Newtons, greater than 1,900 Newtons, greater than 2,000 Newtons, greater than 2,100 Newtons, greater than 2,200 Newtons, greater than 2,300 Newtons, greater than 2,400 Newtons, greater than 2,500 Newtons, greater than 2,600 Newtons, greater than 2,700 Newtons, greater than 2,800 Newtons, greater than 2,900 Newtons, or greater than 3,000 Newtons. In any of the forgoing examples, wet strength can be measured using the wet strength method or the Tappi Test Method T456.

"Alkyl" refers to a straight or branched hydrocarbon chain radical consisting solely of carbon and hydrogen atoms, which is saturated or unsaturated (i.e., contains one or more double (alkenyl) and/or triple bonds (alkynyl)), having, for example, from one to twenty-four carbon atoms ($C_1$-$C_{24}$ alkyl), four to twenty carbon atoms ($C_4$-$C_{20}$ alkyl), six to sixteen carbon atoms ($C_6$-$C_{16}$ alkyl), six to nine carbon atoms ($C_6$-$C_9$ alkyl), one to fifteen carbon atoms ($C_1$-$C_{15}$ alkyl), one to twelve carbon atoms ($C_1$-$C_{12}$ alkyl), one to eight carbon atoms ($C_1$-$C_8$ alkyl) or one to six carbon atoms ($C_1$-$C_6$ alkyl) and which is attached to the rest of the molecule by a single bond, e.g., methyl, ethyl, n-propyl, 1-methylethyl (iso propyl), n butyl, n pentyl, 1,1-dimethylethyl (t butyl), 3-methylhexyl, 2-methylhexyl, ethenyl, prop-1-enyl, but-1-enyl, pent-1-enyl, penta-1,4-dienyl, ethynyl, propynyl, butynyl, pentynyl, hexynyl, and the like. Unless stated otherwise specifically in the specification, an alkyl group is optionally substituted.

"Alkylamino" refers to the group —NRR', where R and R' are each independently either hydrogen or alkyl, and at least one of R and R' is alkyl. Alkylamino includes groups such as piperidino wherein R and R' form a ring. The term "alkylaminoalkyl" refers to -alkylene-NRR'.

"Alkylene" refers to a straight or branched divalent or multivalent hydrocarbon chain linking the rest of the molecule to a radical group or linking two or more radical groups, consisting solely of carbon and hydrogen, which is saturated or unsaturated (i.e., contains one or more double and/or triple bonds), and having from one to twelve carbon atoms, e.g., methylene, ethylene, propylene, n-butylene, ethenylene, propenylene, n-butenylene, propynylene, n-butynylene, and the like. The alkylene chain is attached to the rest of the molecule and/or radical group(s) through a single or double bond. The points of attachment of the alkylene chain to the rest of the molecule and/or to the radical group(s) can be through one carbon or any two carbons within the chain. Unless stated otherwise specifically in the specification, an alkylene chain is optionally substituted.

"Haloalkylene" refers to an alkylene, as defined above, wherein at least one H is replaced by a halogen radical, for example, fluoro, chloro, bromo, iodo, or combinations thereof. Unless otherwise stated specifically in the specification, a haloalkylene group is optionally substituted.

"Cycloalkyl" refers to a stable non-aromatic monocyclic or polycyclic carbocyclic radical consisting solely of carbon and hydrogen atoms, which may include fused or bridged ring systems, having from three to fifteen carbon atoms, preferably having from three to ten carbon atoms, and which is saturated or unsaturated and attached to the rest of the molecule by a single bond. Monocyclic radicals include, for example, cyclopropyl, cyclobutyl, cyclopentyl, cyclohexyl, cycloheptyl, and cyclooctyl. Polycyclic radicals include, for example, adamantyl, norbornyl, decalinyl, 7,7-dimethylbicyclo[2.2.1]heptanyl, and the like. A "cycloalkylene" is a divalent or multivalent cycloalkyl, which typically connects one portion a molecule to a radical group or connects two or more radical groups. Unless otherwise stated specifically in the specification, a cycloalkyl (or cycloalkylene) group is optionally substituted.

"Heteroalkylene" refers to an alkylene group, as defined above, comprising at least one heteroatom (e.g., N, O, P or S) within the alkylene chain or at a terminus of the alkylene chain. In some embodiments, the heteroatom is within the alkylene chain (i.e., the heteroalkylene comprises at least one carbon-heteroatom-carbon bond). In other embodiments, the heteroatom is at a terminus of the alkylene and thus serves to join the alkylene to the remainder of the molecule (e.g., M1-H-A-M2, where M1 and M2 are portions of the molecule, H is a heteroatom and A is an alkylene). Unless stated otherwise specifically in the specification, a heteroalkylene group is optionally substituted.

"Haloheteroalkylene" refers to a heteroalkylene group, as defined above, wherein at least one H is replaced by a halogen radical, for example, fluoro, chloro, bromo, iodo, or combinations thereof. Unless otherwise stated specifically in the specification, a haloheteroalkylene group is optionally substituted.

"Cycloheteroalkylene" refers to a heteroalkylene group, as define above (e.g., M1-H-A-Cy-M2, where M1 and M2 are portions of the molecule, H is a heteroatom, A is an alkylene, and Cy is a cycloalkylene. Unless otherwise stated specifically in the specification, a cycloheteroalkylene group is optionally substituted.

"Aryl" refers to a ring system comprising at least one carbocyclic aromatic ring. In some embodiments, an aryl comprises from 6 to 18 carbon atoms. The aryl ring may be a monocyclic, bicyclic, tricyclic or tetracyclic ring system, which may include fused or bridged ring systems. Aryls include, but are not limited to, aryls derived from aceanthrylene, acenaphthylene, acephenanthrylene, anthracene, azulene, benzene, chrysene, fluoranthene, fluorene, as-indacene, s-indacene, indane, indene, naphthalene, phenalene, phenanthrene, pleiadene, pyrene, and triphenylene. Unless stated otherwise specifically in the specification, an aryl group is optionally substituted.

As used herein, "arylene" refers to a divalent or multivalent aryl group which links a portion of a molecule to a radical group, two or more radical groups, or a portion of a first molecule to a portion of a second molecule. Unless stated specifically otherwise, an arylene is optionally substituted.

"Heteroaryl" refers to a 5- to 14-membered ring system radical comprising one to thirteen carbon atoms, one to six heteroatoms selected from the group consisting of nitrogen, oxygen and sulfur, and at least one aromatic ring. For purposes of this disclosure, the heteroaryl radical may be a monocyclic, bicyclic, tricyclic or tetracyclic ring system, which may include fused or bridged ring systems; and the nitrogen, carbon or sulfur atoms in the heteroaryl radical may be optionally oxidized; the nitrogen atom may be optionally quaternized. Examples include, but are not limited to, azepinyl, acridinyl, benzimidazolyl, benzothiazolyl, benzindolyl, benzodioxolyl, benzofuranyl, benzooxazolyl, benzothiazolyl, benzothiadiazolyl, benzo[b][1,4]dioxepinyl, 1,4-benzodioxanyl, benzonaphthofuranyl, benzoxazolyl, benzodioxolyl, benzodioxinyl, benzopyranyl, benzopyranonyl, benzofuranyl, benzofuranonyl, benzothienyl (benzothiophenyl), benzotriazolyl, benzo[4,6]imidazo[1,2-a]pyridinyl, carbazolyl, cinnolinyl, dibenzofuranyl, dibenzothiophenyl, furanyl, furanonyl, isothiazolyl, imidazolyl, indazolyl, indolyl, indazolyl, isoindolyl, indolinyl, isoindolinyl, isoquinolyl, indolizinyl, isoxazolyl, naphthyridinyl, oxadiazolyl, 2-oxoazepinyl, oxazolyl, oxiranyl, 1-oxidopyridinyl, 1-oxidopyrimidinyl, 1-oxidopyrazinyl, 1-oxidopyridazinyl, 1-phenyl-1H-pyrrolyl, phenazinyl, phenothiazinyl, phenoxazinyl, phthalazinyl, pteridinyl, purinyl, pyrrolyl, pyrazolyl, pyridinyl, pyrazinyl, pyrimidinyl, pyridazinyl, quinazolinyl, quinoxalinyl, quinolinyl, quinuclidinyl, isoquinolinyl, tetrahydroquinolinyl, thiazolyl, thiadiazolyl, triazolyl, tetrazolyl, triazinyl, and thiophenyl (i.e. thienyl). "Heteroarylene" is a divalent or multivalent heteroaryl radical. Unless stated otherwise specifically in the specification, heteroaryl and heteroarylene groups are optionally substituted.

As used herein, "haloheteroarylene" refers to a heteroarylene group, as defined above, wherein at least one H is replaced by a halogen radical, for example, fluoro, chloro, bromo, iodo, or combinations thereof. Unless otherwise stated specifically in the specification, a haloheteroarylene group is optionally substituted.

The term "substituted" used herein means any of the above groups (e.g., alkyl, alkylene, alkylamino, alkylaminoalkyl, alkoxy, aryl, arylene, carbocyclyl, cycloalkyl, cycloalkylene, cycloheteroalkylene, haloalkyl, haloalkylene, haloheteroalkylene, heteroalkylene, heterocyclyl, heteroaryl and/or heteroarylene) wherein at least one hydrogen atom is replaced by a bond to a non-hydrogen atom such as, but not limited to: a halogen atom such as F, Cl, Br, and I; an oxygen atom in groups such as hydroxyl groups, alkoxy groups, and ester groups; a sulfur atom in groups such as thiol groups, thioalkyl groups, sulfone groups, sulfonyl groups, and sulfoxide groups; a nitrogen atom in groups such as amines, amides, alkylamines, dialkylamines, arylamines, alkylarylamines, diarylamines, N-oxides, imides, and enamines; a silicon atom in groups such as trialkylsilyl groups, dialkylarylsilyl groups, alkyldiarylsilyl groups, and triarylsilyl groups; and other heteroatoms in various other groups. "Substituted" also means any of the above groups in which one or more hydrogen atoms are replaced by a higher-order bond (e.g., a double- or triple-bond) to a heteroatom such as oxygen in oxo, carbonyl, carboxyl, and ester groups; and nitrogen in groups such as imines, oximes, hydrazones, and nitriles.

For example, "substituted" includes any of the above groups in which one or more hydrogen atoms are replaced with $—NR_gR_h$, $—NR_gC(=O)R_h$—$NR_gC(=O)R_h$, $—NR_gC(=O)NR_gR_h$, $—NR_gC(=O)OR_h$, $—NR_gSO_2R_h$, $—OC(=O)NR_gR_h$, $—OR_g$, $—SR_g$, $—S\ OR_g$, $—SO_2R_g$, $—OSO_2R_g$, $—SO_2OR_g$, $=NSO_2R_g$, and $—SO_2NR_gR_h$. "Substituted" also means any of the above groups in which one or more hydrogen atoms are replaced with $—C(=O)R_g$, $—C(=O)OR_g$, $—C(=O)NR_gR_h$, $—CH_2SO_2R_g$, $—CH_2SO_2NR_gR_h$. In the foregoing, $R_g$ and $R_h$ are the same or different and independently hydrogen, alkyl, alkoxy, alkylaminyl, thioalkyl, aryl, aralkyl, cycloalkyl, cycloalkylalkyl, haloalkyl, heterocyclyl, N-heterocyclyl, heterocyclylalkyl, heteroaryl, N-heteroaryl and/or heteroarylalkyl. "Substituted" further means any of the above groups in which one or more hydrogen atoms are replaced by a bond to an aminyl, cyano, hydroxyl, imino, nitro, oxo, thioxo, halo, alkyl, alkoxy, alkylaminyl, thioalkyl, aryl, aralkyl, cycloalkyl, cycloalkylalkyl, haloalkyl, heterocyclyl, N-heterocyclyl, heterocyclylalkyl, heteroaryl, N-heteroaryl and/or heteroarylalkyl group. In addition, each of the foregoing substituents may also be optionally substituted with one or more of the above substituents.

A "cellulose fiber" or "cellulose fibers" refer to fibrous molecules generally having the structure shown below:

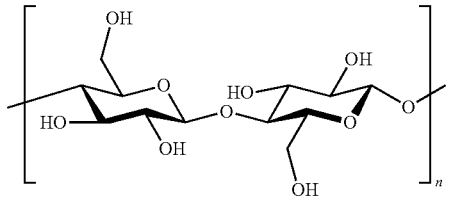

wherein n is an integer greater than 1, for example ranging from 1 to 15,000. A typical example of a substrate comprising a plurality of cellulose fibers is cellulosic paper. Cellulosic paper may comprise fibers such as wood fibers, cotton fibers, as well as other cellulosic fibers, including recycled cellulosic fibers. Particular embodiments are directed to a substrate that is paper comprising cellulose fibers, for example, cellulosic fibers from recycled paper. The substrate is said to be impregnantly covered with a food safe water resistant material, when the material penetrates the surface of the substrate to at least some degree.

"Organo-silicon polymer" or "organosilicon" refers to an organometallic polymer having carbon-silicon bonds. Exemplary organo-silicon polymers can be found in products such as, e.g., FoamStar® ST 2446.

"Star polymer" refers to polymer having a multifunctional core or center from which at least 3 polymer chains, arms, or backbones radially extend. The polymer chains, arms, or backbones can be chemically identical (homostars) or different (heterostars) and have variable length and may provide additional branching. The core or center may be an atom, molecule, or macromolecule. In some embodiments, the star polymer is from, for example, Hydropalat® WE 3322, FoamStar® ST 2446, and the like.

In some embodiments, the first polymer comprises a branched star polymer a fluorinated polymer, or combinations thereof. In some embodiments, the first polymer comprises a fluorinated polymer. Fluorinated polymer-based compositions include, for example, Hydropalat® WE 3370 and the like.

In some embodiments, the food safe water resistant material comprises a first polymer and a second component. The second component may be, for example, a second polymer, mineral oil, a silicone emulsion, 2,4,7,9-tetramethyl-decyn-5-diol ("TMDD") or dioctyl sodium sulfosuccinate ("DOSS"), an additive for increasing slip, surface smoothness, or gloss, a diluent or wetting agent, a surfactant, a filler to provide block resistance, a pigment, a wax, an additive to enhance wet strength, or a combination thereof.

In some embodiments, the food safe water resistant material comprises mineral oil. In some embodiments, the food safe water resistant material comprises a silicone emulsion. In some embodiments, the food safe water resistant material comprises mineral oil, a silicone emulsion, or combinations thereof. Exemplary mineral oil compositions include, e.g., Foamaster® MO 2140, Foamaster® MO 2172, Foamaster® MO 2111 NC, Foamaster® MO 2185, and the like. Exemplary silicone emulsions include, for example, FoamStar® ED 2522 (formerly Dehydran® SE 2) and the like (e.g., ultra-low SVOC silicone emulsions).

In some embodiments, the food safe water resistant material comprises 2,4,7,9-tetramethyl-decyn-5-diol ("TMDD") or dioctyl sodium sulfosuccinate ("DOSS"). In some embodiments, the food safe water resistant material comprises 2,4,7,9-tetramethyl-decyn-5-diol. In some embodiments, the food safe water resistant material comprises dioctyl sodium sulfosuccinate. In some embodiments, the TMDD is from, for example Hydropalat® WE 3650 or the like. In some embodiments, the DOSS is from, for example, Hydropalat® E 3475.

In some embodiments, the food safe water resistant material comprises an additive for increasing slip, surface smoothness, or gloss (i.e., a "slip agent"). Exemplary additives for increasing slip, surface smoothness, or gloss include Efka® SL 3299, Efka® SL 3257 and the like.

In some embodiments, the food safe water resistant material comprises a surfactant. In some embodiments, the surfactant is a polyethylene glycol (PEG) and polypropylene glycol (PPG) block co-polymer. Exemplary surfactants include, e.g., Hydropalat® WE 3966 and the like.

In some embodiments, the food safe water resistant material comprises a diluent or wetting agent. In more specific embodiments, the diluent or wetting agent is a water soluble polyalkylene glycol (PEG, PPG etc.). Diluents and wetting agents include, for example, Hydropalat® WE 3155 and the like.

A "filler to provide block resistance" refers to an additive included in the food safe water resistant material to prevent surfaces in contact in a stack of food safe articles (e.g., a roll of food safe sheet material) from sticking together. A filler to provide tooth for printability and writability refers to an additive included in the food safe water resistant material to impart to its surface a degree of texture or roughness required for printability or writability.

"Outthrows" refers to papers that are so manufactured or treated or are in such a form as to be unsuitable for recyclability or consumption as the specified by grade according to the Institute of Scrap Recycling Industries, Inc. ("ISRI").

A "cross-link" refers to a covalently bonded molecular bridge or linkage between two or more components (e.g., between cellulose fiber(s) and cellulose fiber(s), between polymer(s) and polymer(s), between cellulose fiber(s) and polymer(s)). Both intra and inter-molecular covalent attachments of the aforementioned components and combinations are meant to be included.

"Cross-linking density" refers to a ratio of cross-linking moieties (i.e., isocyanate, isothiocyanate, aziridine, carbodiimide, etc.) to molecular weight of the cross-linking agent. A cross-linking agent having a higher cross-linking density has more cross-linking moieties than a cross-linking agent having a low cross-linking density when molecular weight is held constant. As used herein, the cross-linking density is expressed according to the following equation:

$$CD_{CA} = -\frac{N_{CA}}{MW_{CA}} \times 100$$

wherein:

$CD_{CA}$ is the cross-linking density of the cross-linking agent, $N_{CA}$ is the number of cross-linking moieties on the cross-linking agent (e.g., isocyanate, isothiocyanate, aziridine, carbodiimide, etc.) and $MW_{CA}$ is the molecular weight of the cross-linking agent. For example, a cross-linking reagent having two isocyanate moieties and a molecular weight of 168.20 g/mol would have a cross-linking density of 1.19.

A "polymer" or "polymer molecule" refers to a chemical substance that has a molecular structure comprising a number of subunits (i.e., monomers or repeat units) bonded together to form a molecular chain or backbone. Polymers include, for example, silicone, organosilicon polymers, nylon, polyvinyl chloride, polystyrene, polyethylene, polypropylene, polyacrylonitrile, polyacrylic acid, polyacrylate and the like. In some embodiments, the first polymer comprises at least one polyacrylic polymer, at least one polystyrene polymer, or combinations thereof.

In some embodiments, a first polymer or a second polymer is a copolymer. A "copolymer" refers to a polymer having more than one species of subunits included in the polymer backbone. A copolymer may be a block or random copolymer. In certain embodiments, a copolymer comprises at least one polyacrylic polymer and at least one polystyrene polymer.

"Acrylic polymer" or "polyacrylic polymer" refers to a polymer comprising the following structure:

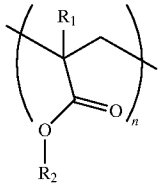

wherein $R_1$ is, at each occurrence, independently H or alkyl (e.g., methyl, ethyl), $R_2$ is, at each occurrence, independently H or alkyl (e.g., methyl, ethyl, butyl, 2-ethylhexyl) and n is an integer greater than 1.

Additionally, polyacrylic polymers include polyacrylonitrile and polyacrylate polymers. Polyacrylic polymers also include, but are not limited to, polyacrylic acid, polymethacrylic acid, polymethyl methacrylate, poly butyl acrylate, or poly 2-ethylhexyl acrylate. In certain embodiments, a polyacrylic polymer comprises mixtures of polyacrylic polymers.

"Styrene polymer" or "polystyrene polymer" refers to polymer comprising the following structure:

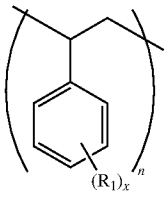

wherein $R_1$ is, at each occurrence, independently H, alkyl, haloalkyl, hydroxyl, alkoxy, or halo, x is an integer ranging from 0 to 5, and n is an integer greater than 1. Examples of polystyrene polymers include polystyrene.

A "styrene acrylic polymer" or "polystyreneacrylic polymer" refers to a copolymer comprising at least one polystyrene polymer and at least one polyacrylic polymer.

Such polymers and copolymers may be synthesized by methods well known in the art, for example, by emulsion copolymerization. Accordingly, in some embodiments, the food safe water resistant material further comprises a plurality of second polymers, for example, wherein the second polymers comprise a copolymer. In some more specific embodiments, the first polymer comprises a polyacrylic polymer, and the second polymer comprises a styrene acrylic copolymer. In another particular embodiment, the first and second polymers are the copolymers present in Lucidene®605, an emulsion prepared and sold by the Rohm and Haas Company of Charlotte, North Carolina ("Rohm and Haas"). In yet another particular embodiment, the food safe water resistant material is derived from Rite in the Rain® Formula #22154A, a product manufactured and sold by Northwest Coatings Corp. of Oak Creek, Wisconsin ("NW Coatings").

The food safe water resistant material has certain properties related to the composition of the first polymer and/or the second polymer that can be changed or adjusted depending on the desired application. For example, in a specific embodiment, the concentration of the food safe water resistant material covering the substrate ranges from about 0.5 grams per square meter to about 10.0 grams per square meter, from about 1.0 grams per square meter to about 8.0 grams per square meter, from about 2.0 grams per square meter to about 7.0 grams per square meter, from about 3.0 grams per square meter to about 6.0 grams per square meter, from about 3.7 grams to about 5.6 grams per square meter or from about 5.6 grams to about 8.5 grams per square meter of the substrate (e.g., per square meter of one or more surface(s) of the substrate).

In some embodiments, the food safe water resistant material has moisture content less than 10% by weight, less than 8% by weight, less than 7% by weight, or less than 6% by weight based on the total weight of the food safe water resistant material. In some of the foregoing embodiments, the polymer or mixture of polymers content is less than 85% by weight, less than 75% by weight, less than 65% by weight, or less than 60% by weight, based on the total weight of the food safe water resistant material. In some more specific embodiments, the food safe water resistant material has moisture content less than 10% by weight and the polymer or mixture of polymers content is less than 85% by weight, the food safe water resistant material has a moisture content less than 8% by weight and the polymer or mixture of polymers content is less than 75% by weight, the food safe water resistant material has a moisture content less than 7% by weight and the polymer or mixture of polymers content is less than 65% by weight, the food safe water resistant material has a moisture content less than 6% by weight and the polymer or mixture of polymers is less than 60% by weight, based on the total weight of the food safe water resistant material. In some embodiments, moisture content is synonymous with water content.

In some embodiments, the food safe water resistant material further comprises a filler to provide block resistance. In some embodiments the food safe water resistant material further comprises a filler to provide tooth for printability and writability. In some embodiments, the food safe water resistant material further comprises a pigment. In various embodiments, the filler to provide block resistance comprises barium sulfate, the filler to provide tooth comprises calcium carbonate, and the pigment comprises titanium dioxide, respectively. The amount of barium sulfate, in one embodiment, ranges from greater than 0% by weight to about 65% by weight, about 17% by weight, or about 38% by weight, based on the total weight of the food safe water resistant material. In some of those embodiments the food safe water resistant material has a moisture content of 5% by weight. In another embodiment, the filler to provide block resistance comprises clay, mica, aluminum trihydrate, or mixtures thereof.

Food safe articles having a color other than white are also disclosed. The color may be obtained by providing a colored substrate, or by providing a color tinting agent in the food safe water resistant material, wherein the color tinting agent comprises an organic or inorganic pigment dispersed in an acrylic resin or other suitable media.

In certain embodiments of the foregoing, the food safe water resistant material further comprises a wax. The amount of the wax is such that water beads up on a food safe water resistant material surface that is also printable and writable. In addition to providing water resistance and causing water to bead up on the food safe water resistant material surface, the wax also provides block resistance and scratch/mar resistance. In one embodiment, the wax is paraffin wax, a polypropylene-wax mixture, a polyethylene-wax mixture, carnauba wax, microcrystalline wax, montan wax, a Fisher-Tropsch wax, beeswax, or a mixture thereof.

In other specific related embodiments, respectively, the amount of the first polymer or combination of first and second polymers (e.g., a mixture of the first and second polymer) ranges from about 30% to about 65% by weight, while the amount of the wax ranges from about 1.5% to about 9.5% by weight; the amount of the first polymer or combination of first and second polymers is about 50% by weight, while the amount of the wax is about 2.5% by weight, where the recited amounts are based on the total weight of the food safe water resistant material and the food safe water resistant material has a moisture content of 5% by weight. In other specific related embodiments, respectively, the amount of the first polymer or combination of first and second polymers ranges from about 30% to about 82%, while the amount of the wax ranges from about 1.5% to about 13%; the amount of the first polymer or combination of first and second polymers is about 52.5%, while the amount of the wax is about 2.7%, where the recited amounts are based on the total weight of the food safe water resistant material and the food safe water resistant material has a moisture content of 5% by weight.

A particular thickness or dimensions of the substrate is selected based on performance for a desired application. Accordingly, in some embodiments the thickness of the substrate or paper ranges from 0.003 inches to 0.013 inches or from 0.004 inches to 0.006 inches.

By way of an additional example, a substrate as described herein includes paper having the specifications described by the United States Government Publishing Office (GPO). Specific examples include, but are not limited to, printing paper water-resistant (text) book paper (JCP A220), 50 pct map lithographic-finish (JCP E10), high wet strength map lithographic-finish (JCP E20), offset map lithographic finish (JCP E30), chemical wood map lithographic finish (JCP E40) and 50 pct chart and lithographic-finish (JCP E50).

By way of a further example, a substrate as described herein includes cardboard, which is a thick, stiff paper. In some embodiments the thickness of a cardboard substrate ranges from 0.01 inches to 0.5 inches or from 0.05 inches to 0.3 inches. In some embodiments the cardboard is corrugated cardboard, which is a layered cardboard that includes an inner layer of cardboard, an outer layer of cardboard, and a fluting layer of paper (e.g., cardboard or a thinner paper) with a ruffled shape, which runs between the inner layer and outer layer. A food safe water resistant corrugated cardboard article (e.g., a food safe water resistant corrugated cardboard box) may be useful, for example, for storage of large volumes of food, storage of heavy food items, and/or for shipment of food.

In any of the foregoing embodiments, the food safe water resistant material comprises a first polymer and may optionally comprise a second polymer, for example, a copolymer or mixture of copolymers comprising at least one polystyrene polymer and at least one polyacrylic polymer. Additionally, the food safe water resistant material may further comprise additional additives such as a wax, a filler to provide block resistance, a filler to provide tooth for printability and writability, and/or a pigment. However, for some of these embodiments, the food safe water resistant material comprises substantially no titanium dioxide pigment or calcium carbonate filler. In some of the foregoing embodiments, the food safe water resistant material comprises an optical brightener.

In further related embodiments, respectively, the food safe article further comprises an additive, such as polyamide, to enhance its wet strength, and the sheet is a color other than white.

In general, a cross-linker may form a covalent bond between a cross-linking agent and a substrate (e.g., cellulose fiber, polymer, cross-linker, additive etc.) through a chemical reaction. The cross-linking agents generally comprise chemical moieties that are able to react to form such linkages. In some embodiments, a covalent bond is formed between a substrate, a polymer, a cross-linker, and/or combinations thereof. In certain related embodiments, the covalent bond is formed by reaction of an isocyanate, an isothiocyanate, an aziridine, a carbodiimide, and/or combinations thereof, which is attached to a cross-linking agent. Accordingly, in certain embodiments, the food safe article comprises at least one cross-link having one of the following structures (I), (II), (III) or (IV):

(I)

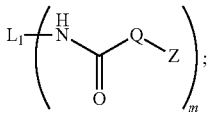

(II)

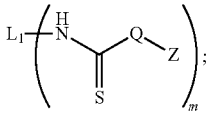

(III)

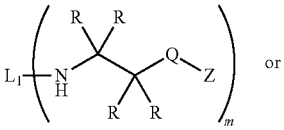

or (IV)

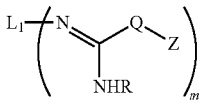

wherein:

$L_1$ is a multi-valent linker comprising optionally substituted alkylene, haloalkylene, cycloalkylene, heteroalkylene, haloheteroalkylene, cycloheteroalkylene, arylene, haloarylene, or haloheteroarylene;

m is an integer greater than 1;

Q is O, S or $NR^a$, wherein $R^a$ is H or alkyl;

R is at each occurrence, independently H, alkyl, cycloalkyl, alkylaminoalkyl or halo; and Z is at each occurrence, independently H, one of the plurality of polymer molecules or one of the plurality of cellulose fibers, provided that Z is not H for at least two occurrences.

In more specific embodiments, the cross-link has the following structure (I):

(I)

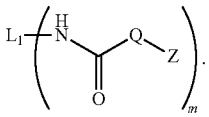

In some embodiments, the cross-link has the following structure (II):

(II)

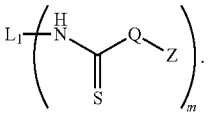

In some more specific embodiments, the cross-link has the following structure (III):

(III)

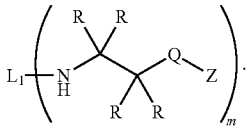

In certain embodiments, the cross-link has the following structure (IV):

(IV)

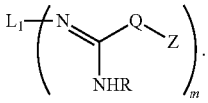

Without wishing to be bound by theory, Applicants have discovered that cross-linking density can have a significant effect on wet strength as well as drying and curing times. Accordingly, in certain embodiments, the cross-linking agent has a crosslinking density ranging from greater than 0 to less than 10. In some embodiments, the cross-linking agent has a crosslinking density ranging from greater than 0 to less than 3. In some more specific embodiments, the cross-linking agent has a crosslinking density ranging from greater than 0 to less than 2.

In certain specific embodiments, the cross-linking agent has a cross-linking density ranging from 0.01 to 3.00, from 0.01 to 2.00, from 0.01 to 1.50, from 0.01 to 1.40, from 0.01 to 1.30, from 0.01 to 1.20, from 0.01 to 1.30, from 0.01 to 1.25, from 0.01 to 1.20, from 0.01 to 1.15, from 0.01 to 1.10, from 0.01 to 1.05, from 0.01 to 1.00, from 0.01 to 0.95, from 0.01 to 0.90, from 0.01 to 0.85, from 0.01 to 0.80, from 0.01 to 0.75, from 0.01 to 0.65, from 0.01 to 0.60, from 0.01 to 0.55, from 0.01 to 0.50, from 0.01 to 0.45, from 0.01 to 0.40, from 0.01 to 0.35, from 0.01 to 0.30, from 0.01 to 0.25, from 0.01 to 0.20, from 0.01 to 0.15, from 0.01 to 0.10, or from 0.01 to 0.05.

In some embodiments, the cross-linking agent has a cross-linking density ranging from 0.05 to 3.00, from 0.15 to 3.00, from 0.10 to 3.00, from 0.15 to 3.00, from 0.20 to 3.00, from 0.25 to 3.00, from 0.30 to 3.00, from 0.35 to 3.00, from 0.40 to 3.00, from 0.45 to 3.00, from 0.50 to 3.00, from 0.55 to 3.00, from 0.60 to 3.00, from 0.65 to 3.00, from 0.70 to 3.00, from 0.75 to 3.00, from 0.80 to 3.00, from 0.85 to 3.00, from 0.90 to 3.00, from 0.95 to 3.00, from 1.00 to 3.00, from 1.05 to 3.00, from 1.10 to 3.00, from 1.15 to 3.00, from 1.20 to 3.00, from 1.25 to 3.00, from 1.30 to 3.00, from 1.40 to 3.00, from 1.50 to 3.00, from 2.00 to 3.00, or from 2.50 to 3.00.

Certain embodiments of the present disclosure relate to food safe paper and food safe paper products that can be recycled using conventional techniques. Certain embodiments of the present disclosure meet grade definitions set forth by the Institute of Scrap Recycling Industries' *Scrap Specifications Circular* (2016), which is incorporated herein by reference in its entirety, specifically pages 28-31. Accordingly, in some of the foregoing embodiments, the sheet is Grade 1 through 52 stock, 1-S through 36-S stock, or combinations thereof. In some specific embodiments, the sheet is Grade 1, Grade 2, Grade 3, Grade 10, Grade 17, Grade 22, Grade 25, Grade 26, Grade 27, Grade 28, Grade 30, Grade 31, Grade 35, Grade 36, Grade 37, Grade 40, Grade 41, Grade 43, Grade 44, Grade 45, Grade 17-S, Grade 18-S, Grade 19-S, Grade 20-S, Grade 22-S, or any combination thereof. In certain embodiments, outthrows do not exceed 5%, 4%, 3%, 2%, 1%, 0.5%, 0.4%, 0.3% 0.2%, 0.1% or 0%. In certain embodiments, prohibited materials do not exceed 5%, 4%, 3%, 2%, 1%, 0.5% 0.4%, 0.3% 0.2%, 0.1% or 0%.

In some more specific embodiments, Li is selected from hexamethylene, 4,4'-diphenylmethylene, methyl-phenylene, and phenylene. In some embodiments, Li is selected from 1,1'-[2-ethyl-2-[[3-(2-methyl-1-aziridinyl)-1-oxopropoxy]methyl]-1,3-propanediyl] ester and 1,1'-[2-[[3-(1-aziridinyl)-1-oxopropoxy]methyl]-2-(hydroxymethyl)-1,3-propanediyl] ester. In some specific embodiments, the cross-linking reagent is Desmodur VPLS2396 and the first polymer further comprises a polystyrene polymer. In some embodiments, the cross-linking agent is an isocyanate (i.e., —NCO) containing aliphatic urethane polyacrylic polymer.

In some embodiments, the cross-linking agent comprises one or more component(s), or combinations thereof, wherein the components are selected from Table 1 below:

Table 1. Specific Examples of Cross-Linking Agents.

TABLE 1

Specific examples of cross-linking agents.

| Trade Name | Manufacturer | Class† | Trade Name | Manufacturer | Class† |
|---|---|---|---|---|---|
| Basinet ® HW 1000 | BASF | I | CARBODILITE ™ V-10 | GSI Exim America, Inc | C |
| Basonat ® HW 1180 PC | BASF | I | CARBODILITE ™ V-04 | GSI Exim America, Inc | C |
| Basonat ® HW 2000 | BASF | I | CARBODILITE V-02B | GSI Exim America, Inc | C |
| Bayhydur ® 302 | Covestro | I | CARBODILITE ™ V-02-L2 | GSI Exim America, Inc | C |
| Bayhydur ® BL 5335 | Covestro | I | CARBODILITE ™ E-02 | GSI Exim America, Inc | C |
| Bayhydur ® BL XP 2706 | Covestro | I | CARBODILITE ™ V-02 | GSI Exim America, Inc | C |
| Bayhydur ® HD 2018 | Covestro | I | CARBODILITE ™ SV-02 | GSI Exim America, Inc. | C |
| Bayhydur ® XP 2547 | Covestro | I | CARBODILITE E-05 | GSI Exim America, Inc. | C |
| Bayhydur ® XP 7165 | Covestro | I | Picassian ® XL-701 | Stahl Polymers | C |
| Desmodur ® E 14 | Covestro | I | Picassian ® XL-702 | Stahl Polymers | C |
| Desmodur VPLS2396 | Covestro | I | Picassian ® XL-725 | Stahl Polymers | C |
| Bayhydur 401-70 | Covestro | I | Picassian ® XL-732 | Stahl Polymers | C |
| Desmodur XP 2510 | Covestro | I | Joncryl ® 540 | BASF | SC |
| Bayhydur 305 | Covestro | I | RAYCORE ® 9021A | Specialty Polymers, Inc. | SC |
| Bayhydur 2547 | Covestro | I | RayCryl ® 4100 | Chan Sieh Enterprises Co, Ltd. | SC |
| Desmodur HL BA | Covestro | I | PB-155 | Chan Sieh Enterprises Co, Ltd. | SC |
| Desmolux XP 2666 | Covestro | I | P-125U | Chan Sieh Enterprises Co, Ltd. | SC |
| Bayhydur 401-70 | Covestro | I | P-145U | Chan Sieh Enterprises Co, Ltd. | SC |
| Byhydur 2547 | Covestro | I | P-155U | Chan Sieh Enterprises Co, Ltd. | SC |
| AM-1091 | Quaker Color | I | P-103 | Chan Sieh Enterprises Co, Ltd. | SC |

TABLE 1-continued

Specific examples of cross-linking agents.

| Trade Name | Manufacturer | Class† | Trade Name | Manufacturer | Class† |
|---|---|---|---|---|---|
| AM-1345XL | Quaker Color | I | EPS ® 2293 | EPS Materials | SC |
| AM-636 | Quaker Color | I | EPS ® 2548 | EPS Materials | SC |
| AS-500 | Quaker Color | I | EPS ® 4203 | EPS Materials | SC |
| Hydrorene 10 | S.A.P.I.C.I. SpA | I | EPS ® 2507 | EPS Materials | SC |
| Hydrorene 33 | S.A.P.I.C.I. SpA | I | A-410 | Chan Sieh Enterprises Co, Ltd. | SC |
| Hydrorene AW 1 | S.A.P.I.C.I. SpA | I | F-45 | Chan Sieh Enterprises Co, Ltd. | SC |
| Akuacure 1070N | T&L Co., Ltd. Polymer Technology Centre | I | WorleeCryl ® 7410 | Worlee-Chemie G.m.b.H. | SC |
| Akuacure 1073N | T&L Co., Ltd. Polymer Technology Centre | I | StanChem 6470 | StanChem, Inc | SC |
| Akuacure 3100F | T&L Co., Ltd. Polymer Technology Centre | I | RayCryl ® 709 | Specialty Polymers | SC |
| Akuacure 3300FN | T&L Co., Ltd. Polymer Technology Centre | I | SETAQUA ™ 6766 | Nuplex Resins LLC | SC |
| Akuacure 4000N | T&L Co., Ltd. Polymer Technology Centre | I | EPS ® 2570 | EPS Materials | SC |
| Akuacure 4002B | T&L Co., Ltd. Polymer Technology Centre | I | PLIOTEC ® SC55 | Omnova Solutions | SC |
| Akuacure 8004N | T&L Co., Ltd. Polymer Technology Centre | I | PLIOTEC ® CR30 | Omnova Solutions | SC |
| Akuacure 8100N | T&L Co., Ltd. Polymer Technology Centre | I | Joncryl ® 2982 | BASF | SC |
| Akuacure 8103N | T&L Co., Ltd. Polymer Technology Centre | I | RAYCRYL ® 1120 | Specialty Polymers, Inc. | SC |
| Akuacure W3000 | T&L Co., Ltd. Polymer Technology Centre | I | RayCryl ® 4102 | Specialty Polymers, Inc. | SC |
| Easaqua X D M 501 | Vencorex | I | Ottopol SX-30 | Gellner Industrial, LLC | SC |
| Easaqua X D 401 | Vencorex | I | Ottopol SX-50 | Gellner Industrial, LLC | SC |
| Easaqua™M M 502 | Vencorex | I | Ottopol SX-75 | Gellner Industrial, LLC | SC |
| Easaqua ™ WAT-3 | Vencorex | I | Ottopol SX-100 | Gellner Industrial, LLC | SC |
| Easaqua™M WAT-4 | Vencorex | I | Unithane SX-482 NF | Union Specialties, Inc | SC |
| Easaqua ™ X D 803 | Vencorex | I | PLIOTEC ® SC105 | Omnova Solutions | SC |
| Easaqua ™ X L 600 | Vencorex | I | Texicryl ® 13-220 | Scott Bader | SC |
| WANNATE ® IPDI Monomer | Wanhua Chemical Group Co., Ltd. | I | BT-WBE1133 | BELIKE Chemical Co.,Ltd. | SC |
| Crosslinker ® CX-100 | DSM Coating Resins, LLC. | A | Joncryl ® 1980 | BASF Dispersions & Resins | SC |
| PZ-28 | Polyaziridine | A | ROSHIELD ™ 4000 | Dow Coating Materials | SC |
| PZ-33 | Polyaziridine | A | Picassian ® AC-192 | Stahl Polymers | SC |

TABLE 1-continued

Specific examples of cross-linking agents.

| Trade Name | Manufacturer | Class† | Trade Name | Manufacturer | Class† |
|---|---|---|---|---|---|
| CARBODILITE ™ SW-12G | GSI Exim America, Inc | C | Joncryl ® 1987 | BASF Dispersions & Resins | SC |
| CARBODILITE ™ E-03A | GSI Exim America, Inc | C | CARBODILITE ™ SV-02 | GSI Exim America, Inc. | C |
| No. 219 Isocyanate | Nexeo Solutions | C | Bayhydur XP 2655 | Covestro | I |
| Lupranate ® MM103 | Nexeo Solutions | C | — | — | — |
| Lupranate ® 5143 | Nexeo Solutions | C | — | — | — |

†C = carbodiimide, I = Isocyanate, A = Aziridine, SC = Self-Cross-linker

In certain embodiments, the cross-linking agent is covalently bound to the first polymer (a "self-cross-linking polymer"). In some embodiments, the food safe water resistant composition further comprises a surfactant. Example surfactants include, but are not limited to, those found in Table 2 below.

Table 2. Specific Examples of Surfactants.

TABLE 2

Specific Examples of surfactants.

| Trade Name | Manufacturer | Trade Name | Manufacturer |
|---|---|---|---|
| Carbowet GA 210 | Air Products/Evonic | Carbowet GA 211 | Air Products/Evonic |
| Carbowet GA 100 | Air Products/Evonic | COATOSIL* 1221 | Momentive |
| Carbowet 100 | Air Products/Evonic | ECOSURF LF-20 | Dow Coating Materials |
| Carbowet 106 | Air Products/Evonic | ECOSURF LF-30 | Dow Coating Materials |
| Carbowet 109 | Air Products/Evonic | ECOSURF LF-45 | Dow Coating Materials |
| Carbowet 107L | Air Products/Evonic | XOANONS WE-D9015 (Fluorine) | Anhui Xoanons Chemical Co., Ltd. |
| Strodex PK-85NV | Ashland | Dynol 800 | Air Products/Evonic |
| Maxemul 5010 (Copolymerizable Nonionic) | Croda Coatings & Polymers | Dynol 810 | Air Products/Evonic |
| LoVOCoat Form 100 (Polymeric) | Croda Coatings & Polymers | Sufynol 485 | Air Products/Evonic |
| SURFONAMINE L-207 (Amine) | Huntsman Performance Products | Surfynol 465 | Air Products/Evonic |
| Surfonic NB-407 | Nexeo Solutions | Carbowet 138 | Air Products/Evonic |
| Dynol 960 | Air Products/Evonic | Surfynol 420 | Air Products/Evonic |
| LoVOCoat Stable 100 (Polymeric) | Croda Coatings & Polymers | Surfynol 485W | Air Products/Evonic |
| Strodex FT-428 | Ashland | Surfynol 440 | Air Products/Evonic |
| Dynol 980 | Air Products/Evonic | Dynol 604 | Air Products/Evonic |
| Dynol 607 | Air Products/Evonic | Surfynol 61 | Air Products/Evonic |
| Surfynol AD01 | Air Products/Evonic | Surfynol 104 | Air Products/Evonic |
| Surfynol 500S | Air Products/Evonic | COATOSIL* 1220 | Momentive |
| Dynol 360 | Air Products/Evonic | Surfynol 104A | Air Products/Evonic |
| Dextrol OC-20 (Phosphate Ester) | Ashland | Surfynol 104S | Air Products/Evonic |
| Surfynol 2502 | Air Products/Evonic | Surfynol 104BC | Air Products/Evonic |
| Dextrol OC-78N (Phosphate Ester) | Ashland | XOANONS WE-D8950B | Anhui Xoanons Chemical Co., Ltd. |
| Dextrol OC-5075 (Phosphate Ester) | Ashland | Surfynol 104DPM (Fluorine) | Air Products/Evonic |
| Maxemul 6112 (Copolymerizable Anionic) | Croda Coatings & Polymers | XOANONS WE-8900 | Anhui Xoanons Chemical Co., Ltd. |
| Dextrol OC-180HS (Phosphate Ester) | Ashland | Surfynol 104E | Air Products/Evonic |

TABLE 2-continued

Specific Examples of surfactants.

| Trade Name | Manufacturer | Trade Name | Manufacturer |
|---|---|---|---|
| Maxemul 6106 (Anionic Surfactant) | Croda Coatings & Polymers | Surfynol 104PG-50 | Air Products/Evonic |
| Maxemul 5011 (Copolymerizable Nonionic) | Croda Coatings & Polymers | XOANONS WE-D8975B | Anhui Xoanons Chemical Co., Ltd. |
| Carbowet GA-221 | Air Products/Evonic | Surfynol 104PA | Air Products/Evonic |
| Surfynol 104H | Air Products/Evonic | Tween 40 | Croda Coatings & Polymers |
| XOANONS WE D-8987 (Fluorine) | Anhui Xoanons Chemical Co., Ltd. | Brij O2 | Croda Coatings & Polymers |
| XOANONS WE-D9055 (Fluorine) | Anhui Xoanons Chemical Co., Ltd. | Tween 21 | Croda Coatings & Polymers |
| Dow Corning 1250 | Nexeo Solutions | Span 85 | Croda Coatings & Polymers |
| AC-703 (Anionic Fluorocarbon) | Ark (Fogang) Chemicals Industry Co., Ltd. | Brij O20 | Croda Coatings & Polymers |
| Hostapal BV (concentrated) | Clariant Coatings & Construction Chemicals | E-SPERSE 701 | Ethox Chemicals |
| Genapol PF 40 | Clariant Coatings & Construction Chemicals | Octosol 571 | Tiarco Chemicals |
| Hostapur OS (Liquid) | Clariant Coatings & Construction Chemicals | Brij S2 | Croda Coatings & Polymers |
| ZetaSperse 179 Dispersant | Air Products/Evonic | Brij S10 | Croda Coatings & Polymers |
| ZetaSperse 182 Dispersant | Air Products/Evonic | E-SPERSE 702 | Ethox Chemicals |
| NOVEL TDA-20 ETHOXYLATE | Sasol Performance Chemicals | Brij C2 | Croda Coatings & Polymers |
| NOVEL TDA-30 ETHOXYLATE | Sasol Performance Chemicals | Brij L23 | Croda Coatings & Polymers |
| NOVEL TDA-40 ETHOXYLATE | Sasol Performance Chemicals | Abeson Na 50 | Enapol AS |
| NOVEL 12D20 ETHOXYLATE | Sasol Performance Chemicals | Brij C20 | Croda Coatings & Polymers |
| NOVEL TDA-4070 ETHOXYLATE | Sasol Performance Chemicals | Brij S20 | Croda Coatings & Polymers |
| Emulsogen EPA 1954 | Clariant Coatings & Construction Chemicals | Brij O10 | Croda Coatings & Polymers |
| Genapol PF 20 | Clariant Coatings & Construction Chemicals | Brij S100 | Croda Coatings & Polymers |
| E-SPERSE 700 | Ethox Chemicals | Abeson Na 30 | Enaspol AS |
| E-SPERSE 703 | Ethox Chemicals | Brij L4 | Croda Coatings & Polymers |
| Masurf FS-630 | Pilot Chemical | Abeson | Enaspol AS |
| Flexisurf EHDP | Innovative Chemical Technologies Inc. | Masil SF19 | Emerald Performance Materials |
| Brij S721 | Croda Coatings & Polymers | Genamin BTMS | Clariant Coatings & Construction Chemicals |

In any of the foregoing embodiments, the substrate is paper as described herein above.

B. Method of Preparation

In one embodiment, a method for preparing a food safe article, the method comprising:

i. providing an article comprising a plurality of cellulose fibers; and ii. contacting the article with a food safe water resistant composition thereby forming a food safe water resistant material comprising a plurality of first polymers, wherein the food safe water resistant material impregnantly covering at least a portion of a surface of the substrate.

In some embodiments, the food safe water resistant composition comprises a cross-linking agent as described in any of the foregoing embodiments. In some related embodiments, the contacting forms at least one of the following structures (I"), (II"), (III") or (IV"):

(I')

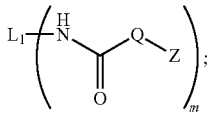

-continued (II')

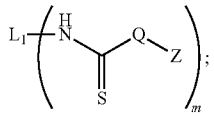

(III')

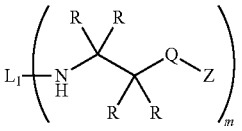

or (IV')

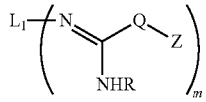

wherein:

$L_1$ is a multi-valent linker comprising optionally substituted alkylene, haloalkylene, cycloalkylene, heteroalkylene, haloheteroalkylene, cycloheteroalkylene, arylene, haloarylene, haloheteroarylene;

m is an integer greater than 1;

Q is O, S or $NR^a$, wherein $R^a$ is H or alkyl;

R is at each occurrence, independently H, alkyl, cycloalkyl, alkylaminoalkyl or halo; and Z is at each occurrence, independently H, one of the first polymers or one of the cellulose fibers, provided that Z is not H for at least two occurrences.

In a related embodiment, the contacting forms the following structure (I'):

(I')

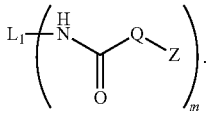

In some other related embodiments, the contacting forms the following structure (II'):

(II')

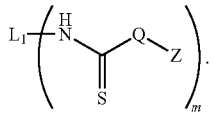

In specific related embodiments, the contacting forms the following structure (III'):

(III')

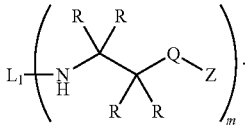

In related embodiments, the contacting forms the following structure (IV'):

(IV')

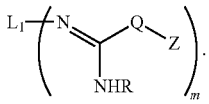

In another specific related embodiment, the food safe water resistant composition is aqueous. In another specific related embodiment, the food safe water resistant composition is non-aqueous (e.g., organic).

In further specific related embodiments, the first polymer of the food safe water resistant composition used for contacting is a copolymer. In other related embodiments, the food safe water resistant composition used for contacting comprises a first polymer and a second polymer (e.g., a mixture of different copolymers).

In some of those embodiments, the polymer is emulsified and the food safe water resistant composition further comprises an emulsified wax. In some specific embodiments, the amount of emulsified copolymer or mixture of copolymers ranges from about 40% by weight to about 80% by weight, while the amount of the emulsified wax ranges from about 3% by weight to about 20% by weight; the amount of the emulsified copolymer or mixture of copolymers is about 64% by weight, while the amount of the emulsified wax is about 5.3% by weight, where the recited amounts are based on the total weight of the food safe water resistant composition.

In further related embodiments, the food safe water resistant composition further comprises a filler to provide block resistance, a filler to provide tooth, a pigment, or a mixture thereof. In those embodiments, respectively, the filler to provide block resistance comprises barium sulfate present in an amount ranging from greater than 0% by weight to about 40% by weight of the food safe water resistant composition, the filler to provide tooth comprises calcium carbonate present in an amount ranging from greater than about 0% by weight to about 10% by weight of the food safe water resistant composition, and the pigment comprises titanium dioxide present in an amount ranging from about 5% by weight to about 15% by weight of the food safe water resistant composition.

The food safe water resistant composition, in another related embodiment, contacting is done by a method that uses a flexographic process, rotogravure, an air knife, a knife coat, a reverse doctor, a Meyer rod, immersion, spray, slot dye, roll nip or combinations thereof. Such processes are generally known to those skilled in the art. An example of a flexographic process of this embodiment is one that employs a series of rotating cylinders that pick up, transfer and apply or contact the food safe water resistant composition to the substrate. An enclosed doctor blade meters the food safe water resistant composition onto a textured anilox roller that, in turn, transfers the food safe water resistant composition to a variable speed printing sleeve. The latter imprints the food safe water resistant composition onto a moving web of the substrate. The food safe water resistant material weight is computer monitored to maintain consistency.

The contacted substrate is dried, in another related embodiment, using an infrared drier and air knife so as to yield a food safe article having a moisture content ranging from about 3% by weight to about 10% by weight of the food safe article. A moisture content that is too low will result in the sheet being too brittle. A moisture content that is too high can result in curling, blocking, a gummy food safe water resistant material, and other undesirable characteristics.

In one embodiment, a food safe water resistant article comprising: a substrate comprising a plurality of cellulose fibers, and a food safe water resistant material impregnantly covering at least a portion of a surface of the substrate is provided. The food safe water resistant article may be made by the above-described methods.

FIG. 1 provides an example of a water resistant material 1 impregnantly covering a portion of a surface of a substrate comprising a plurality of cellulose fibers 2. As shown in FIG. 1, the water resistant material may include a first polymer 3 and a second component 4 (e.g., a filler to provide block resistance).

In some of the foregoing embodiments, the food safe article is a plate, bowl, fork, spoon, knife, straw (see, e.g., FIGS. 2A-2C), cup (see, e.g., FIG. 3A), cup lid (see, e.g., FIG. 3B), wrapper, liner, tray, container (see, e.g., FIGS. 4 and 5), or container lid.

In some embodiments, the article is a water resistant straw 5. In particular embodiments, the water resistant straw 5 comprises a paper substrate having an external straw surface 6 and an internal straw surface 7, formed into a cylindrical shape (see, e.g., FIGS. 2A and 2B), wherein a food safe water resistant material impregnantly covers at least a portion of the external straw surface 6 and at least a portion of the internal straw surface 7. In particular embodiments, the food safe water resistant material covers the entire external straw surface 6 and the entire internal straw surface 7.

Figure 2C:
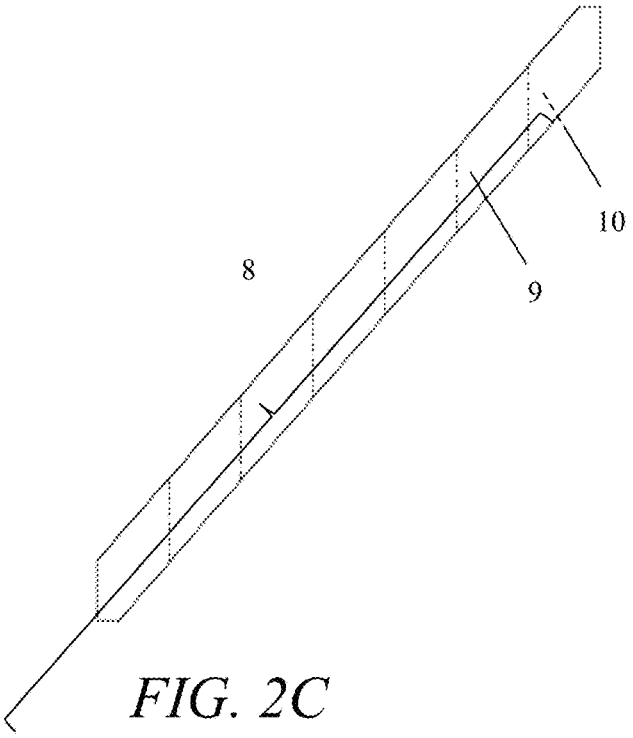
FIG. 2C shows a paper sheet that may be formed into a water resistant straw of FIG. 2A.

In one embodiment, a paper sheet 8 comprising a plurality of cellulose fibers is coated with the food safe water resistant material on a first paper sheet surface 9 and a second paper sheet surface 10 (see, e.g., FIG. 2C). The food safe water resistant material impregnantly covers the cellulose fibers (as shown in FIG. 1) and is integrated with the fibers of the paper. For a paper sheet 8 coated on both surfaces 9 and 10, once the paper sheet 8 is rolled to form a straw 5, both the exterior straw surface 6 and the interior straw surface 7 will include the food safe water resistant material.

FIGS. 2A-2C provide a non-limiting example of how paper may be formed into a straw. As shown in FIGS. 2A-2C, the paper substrate may be formed of an elongated sheet of paper having a shape that, when cyclically wound along an axis diagonal to the length of the paper, forms a cylindrical shape. The cyclically wound sheet of paper may have portions of itself attached together by a food safe adhesive, to secure the cylindrical shape.

Alternatively, an elongated rectangular sheet of paper may be formed into a cylindrical shape by attaching together the edges of each of the two long sides of the paper (e.g., using a food safe adhesive). At least a portion of the paper sheet (e.g., one or both edges of each of the two long sides of the paper) may be coated with a food safe adhesive prior to forming the cylindrical shape.

As another alternative, the cylindrically shaped paper may be formed of multiple sheets of a paper that are connected (e.g., by a food safe adhesive) and folded or wound into the cylindrical shape.

For a water resistant straw having a cylindrical shape formed by any method, the straw may have an inner surface and an outer surface that are impregnantly coated with a food safe water resistant material. The inner and outer surfaces of the paper substrate may be impregnantly coated with the food safe water resistant material before the paper is secured into a cylindrical shape, or after the paper is secured into a cylindrical shape. In certain embodiments, the inner and outer surfaces of the paper substrate may be impregnantly coated with the food safe water resistant material after the paper is secured into a cylindrical shape.

In certain embodiments, the paper substrate may be impregnantly coated with the food safe water resistant material before the paper is secured into a cylindrical shape. For example, coating the paper with the food safe water resistant material and applying a food safe adhesive may be performed in a single step prior to forming the cylindrical shape. In some embodiments, coating the paper with the food safe water resistant material and applying the food safe adhesive are performed by immersing the paper in a bath that includes the food safe adhesive and the food safe water resistant material. The straw may be formed into the cylindrical shape prior to the setting, curing, or hardening of the food safe adhesive.

Figure 3A:
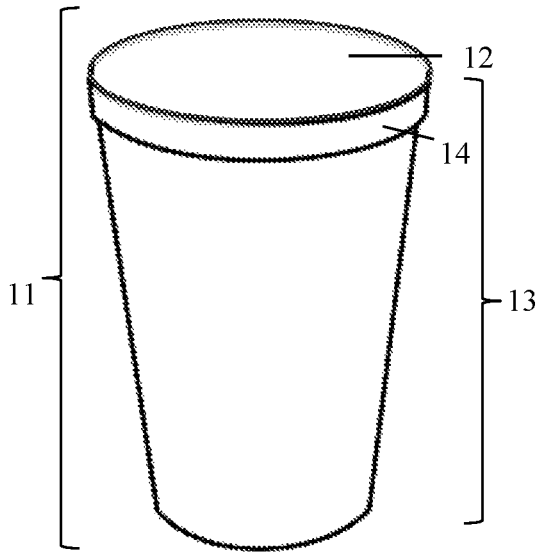
FIGS. 3A and 3B show a cup (FIG. 3A) and a cup lid (FIG. 3B) as exemplary water resistant articles.
Figure 3B:
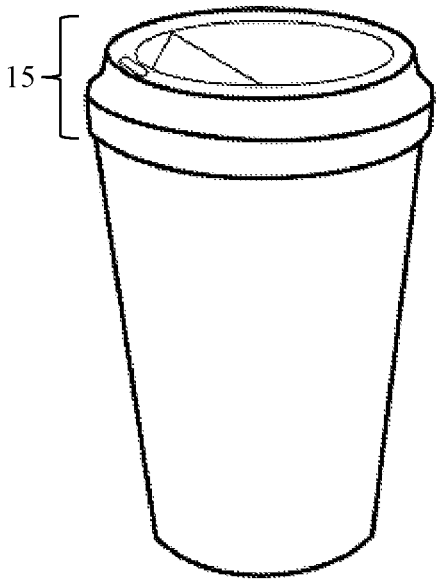

In some embodiments, the article is a water resistant cup 11 (see, e.g., FIG. 3A). In particular embodiments, the water resistant cup 11 comprises a paper substrate having an internal cup surface 12 and an external cup surface 13, wherein a food safe water resistant material impregnantly covers at least a portion of the internal cup surface 12. In particular embodiments the food safe water resistant material impregnantly covers the entire internal cup surface 12. In particular embodiments, the food safe water resistant material impregnantly covers the internal cup surface 12, and at least a portion of the external cup surface 13. In particular embodiments, the food safe water resistant material impregnantly covers the internal cup surface 12 and an external lip 14 of the cup. In certain embodiments, the article is a water resistant cup lid 15 (see FIG. 3B). In particular embodiments, the water resistant cup lid 15 comprises a paper substrate shaped into a lid and having an internal surface and an external surface, wherein a food safe water resistant material impregnantly covers the internal surface and the external surface.

Figure 4:
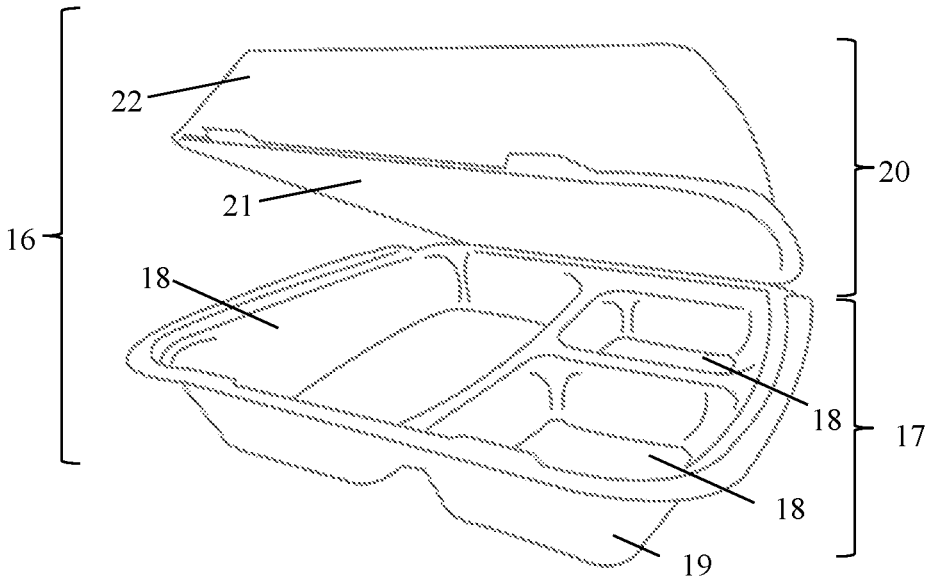
FIG. 4 shows a container with a closeable lid as an exemplary water resistant article.
Figure 5:
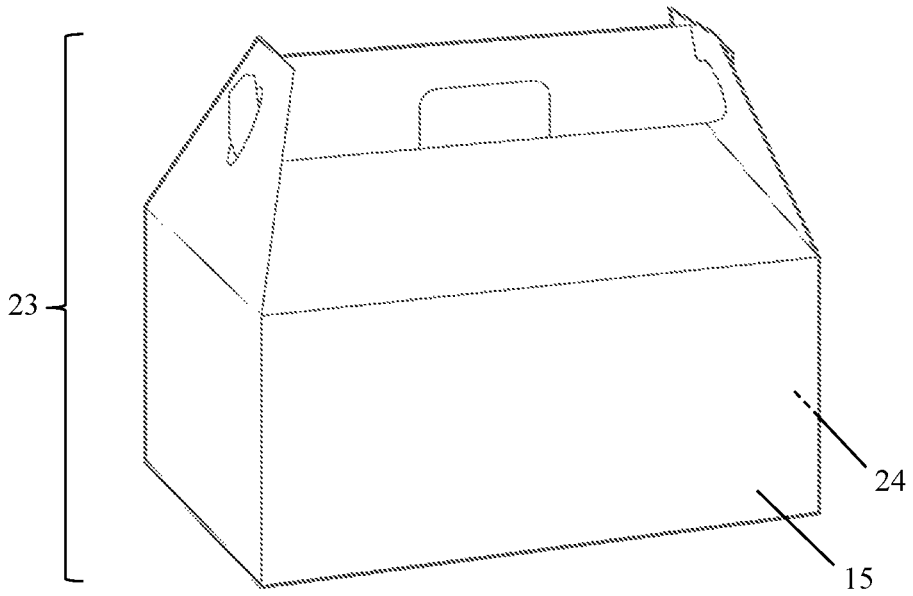
FIG. 5 shows a folded take-out container as an exemplary water resistant article.
Figure 6:
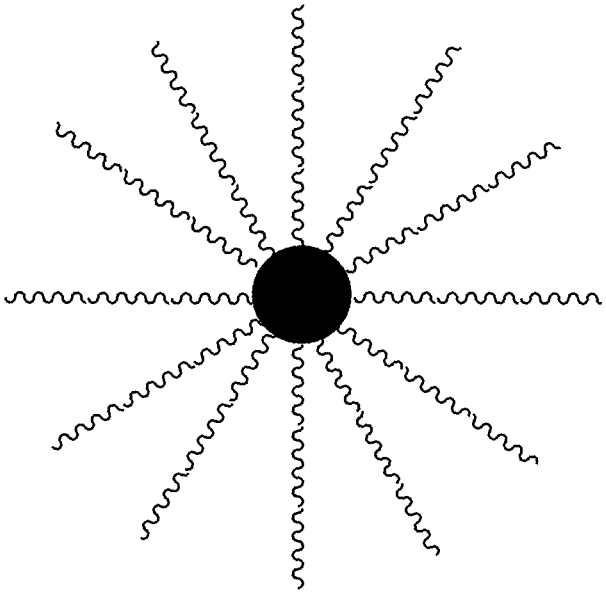
FIG. 6 is an exemplary structure of a star polymer.

In some embodiments, the article is a water resistant food container. FIGS. 4 and 5 provide exemplary embodiments of a water resistant food container.

In particular embodiments, the water resistant food container comprises a food container with a closeable lid (see, e.g., FIG. 4). The food container with a closeable lid 16 may include lower container piece 17 having an internal surface 18 and an external surface 19, and a closeable lid 20 having an internal surface 21 and an external surface 14, wherein a food safe water resistant material impregnantly covers at least a portion the internal surface 18 of the lower container piece 17. In particular embodiments, the food safe water resistant material impregnantly covers the entire internal surface 18 of the lower container piece 17. In particular embodiments, the food safe water resistant material impregnantly covers the internal surface 18 of the lower container piece 17 and the internal surface 21 of the closeable lid 20. In particular embodiments, the food safe water resistant material impregnantly covers the internal surface 18 and the external surface 19 of the lower container piece 17, and the internal surface 21 and the external surface 22 of the closeable lid.

In particular embodiments, the water resistant food container comprises a folded take-out container (see, e.g., FIG. 4). In particular embodiments, the folded take-out container 23 is formed by a single paper sheet having a first surface and a second surface, such that when folded, the first paper sheet surface forms an internal surface 24 of the folded take-out container, and the second paper sheet surface forms an external surface 25 of the folded take-out container. The food safe water resistant material may impregnantly cover at least a portion of the internal surface 24 of the folded take-out container 23. In particular embodiments, the food safe water resistant material impregnantly covers the entire internal surface 24 of the folded take-out container 23. In particular embodiments, the food safe water resistant material impregnantly covers the internal surface 24 and the external surface 25 of the folded take-out container 23.

C. Method of Use

One embodiment provides use of a food safe article for consuming, serving, transporting, storing, or disposing of food wherein the food safe article comprises a substrate comprising a plurality of cellulose fibers; and a food safe water resistant material, wherein the food safe water resistant material impregnantly covering at least a portion of a surface of the substrate. In some more specific embodiments, the food safe article is a plate, bowl, fork, spoon, knife, straw, cup (see, e.g., FIG. 4), wrapper, liner, box, or container (see, e.g., FIGS. 2 and 3).

In some embodiments, the food safe water resistant composition comprises an organo-silicon polymer, a star polymer, mineral oil, a silicone emulsion, a fluorinated polymer, a wetting agent, a slip agent, a diluent, TMDD, DOSS, a surfactant, or combinations thereof. In some more specific embodiments, the food safe water resistant composition comprises FoamStar® ST 2446, Foamaster® MO 2140, Foamaster® MO 2172, Foamaster® MO 2111 NC, Foamaster® MO 2185, FoamStar® ED 2522 (formerly Dehydran® SE 2), Hydropalat® WE 3650, Hydropalat® WE 3322, Hydropalat® WE 3370, Efka® SL 3299, Efka® SL 3257, Hydropalat® E 3475, Hydropalat® WE 3966, Hydropalat® WE 3155, and the like, or combinations thereof.

Also, in particular embodiments, respectively, the food safe water resistant composition comprises Clear Rite in the Rain® Formula #22560B, manufactured and sold by NW Coatings; the amount of food safe water resistant composition applied during contacting ranges from 1.7 to 2.6 pounds per ream per side; and during contacting, the composition is impregnantly applied by a method that uses a flexographic process, rotogravure, an air knife, a knife coat, a reverse doctor, a Meyer rod, immersion, spray, slot dye, roll nip, or combinations thereof. As before, in a related embodiment, the emulsified mixture of copolymers is Lucidene®605, a product prepared and sold by Rohm and Haas.

Further, in another particular embodiment, barium sulfate is used as the filler to provide block resistance, as the filler to provide tooth, and as the pigment, where the amount of barium sulfate, in one embodiment, ranges from greater than 0% by weight to about 40% by weight, and the amount, in another embodiment, is about 23% by weight. The recited amounts are based on the total weight of the food safe water resistant composition.

Finally, in yet another particular embodiment, the drying step is carried out using infrared dryers and air knives so as to yield a food safe water resistant article having a moisture content ranging from about 4% by weight to about 7% by weight by weight of the food safe water resistant article. By way of illustration, during the drying step, the substrate having the food safe water resistant composition applied thereon may be maintained at 200° F. until the desired moisture content is obtained.

From the foregoing it will be appreciated that, although specific embodiments have been described herein for purposes of illustration, various modifications may be made without deviating from the spirit and scope of this disclosure. Accordingly, this disclosure is not limited except as by the appended claims.

EXAMPLES

Example 1

Application of Food Safe Water Resistant Composition to Substrate

Food safe water resistant articles are prepared using standard flexography techniques. In general, a fountain roller is used to transfer the food safe water resistant composition to the metering roller. The metering roller carries a desired amount of the food safe water resistant composition and deposits it to flexibly mounted printing plate mounted on plate cylinders. This ensures the food safe water resistant composition is deposited with a uniform thickness. A doctor blade is optionally employed to scrape the metering roller, if needed. An impression cylinder then applies pressure to the plate cylinder to transfer the food safe water resistant composition only to the substrate. Sample drying is optionally used (e.g., infrared radiation) as a final step in the process.

Example 2

Wet Strength Method

Samples are prepared according to Example 1 and tested with control left un-treated. Samples are cut in to ½ inch×10 inch strips using a Cheminstruments ½ inch specimen cutter (part no. SC-050). Care is taken to keep the instrument blades sharp to ensure clean edges are maintained. The end of each strip is secured to a test plate or clamp, that allow the attachment of a mass or testing fixture to the specimen, distributing the load equally across the width of the strip. This is done by using an approximately 1.5 inch portion of each end of the strips. End of the strips are looped through the test plate and secured to itself with tape.

A three inch portion near the middle of the strip is submerged in distilled water in a beaker for a controlled time period (i.e., 5 minutes unless otherwise noted). Care is taken to ensure only the middle portion of the strip is treated and ends of the strip are not wet. After soaking, strips are removed from the water and gently patted dry with a Kimwipe. Strips are attached, spanning vertically from bench (at the bottom) and a pull/force tester (at the top; HF-500 Digital Push Pull Gauge Force). The samples are then subjected to tensile force (i.e., pulled) until strips broke. Peak force during testing is measured (in Newtons) and recorded. The highest and lowest recorded values are discarded and the average measurement of the 3 remaining values is reported.

Example 3

Effect of Various Cross-Linkers

Various cross-linkers are included in food safe water resistant compositions and are applied and tested on 24 pound recycled paper ("RP") and 24 pound wet strength paper ("WP") for each sample type tested, including control samples according to the procedure described in Example 2.

Example 4

Viscosity of Food Safe Water Resistant Compositions

Food safe water resistant compositions used to contact the cellulosic substrate have different viscosities based on composition and environmental conditions (e.g., water drying). It is important to note that viscosity measurements over time (i.e., approximately 8 hours) of the food safe water resistant composition must be maintained so the food safe water resistant composition is pourable for manufacturing applications. To test viscosity, cross-linking agent is added at a concentration of 3% by weight. The compositions are mixed well and kept sealed to eliminate evaporation during intervals between testing. The testing procedures are performed according to the instrument manual (Brookfield Dial Viscometer—Manual No. M/85-150-P700). Test samples remain exposed to air during test measurements.

Example 5

Recyclability Testing

In one important aspect, a food safe water resistant article can be recycled using conventional equipment and techniques. To simulate conventional recycling conditions, treated samples are cut into 1 inch squares and apportioned into 20 gram samples. The squares are added to 500 mL of distilled water and mixed using a high speed mechanical bladed mixer (1000 watt Nutribullet) at approximately 25,000 rpm for 10 minutes. Of the resultant mixture, 25 mL is added to an additional 175 mL of distilled water in a glass container (e.g., beaker or flask) and particulate is observed. Visible particulate is noted based on visual inspection.

Example 6

Iodine Testing

Food safe water resistant material quality is assessed using iodine testing. The test is performed by preparing a distilled water solution with 5% iodine. Three drops of the prepared solution are deposited onto samples prepared with or without cross-linking agents. Solution remains on each sample for 30 seconds and samples are gently patted dry and observed. Dark/blue spots indicate areas of the sample where iodine solution is able to penetrate (i.e., where food safe water resistant material is not present).

The invention claimed is:

1. A food safe article comprising:

a paper substrate comprising a plurality of cellulose fibers; and a food safe water resistant material comprising an organo-silicon polymer, wherein the food safe water resistant material impregnantly covers at least a portion of a surface of the paper substrate thereby imparting a wet strength of at least 2,000 Newtons to the paper substrate.

2. The food safe article of claim 1, wherein water resistant material further comprises a branched star polymer or a fluorinated polymer.

3. The food safe article of claim 1, wherein the food safe water resistant material comprises mineral oil, a silicone emulsion, or combinations thereof.

4. The food safe article of claim 1, wherein the food safe water resistant material comprises 2,4,7,9-tetramethyl-decyn-5-diol or dioctyl sodium sulfosuccinate.

5. The food safe article of claim 1, wherein the food safe water resistant material comprises a slip agent.

6. The food safe article of claim 1, wherein the food safe water resistant material comprises a diluent, wetting agent, or surfactant.

7. The food safe article claim 1, wherein the food safe water resistant material comprises polyethylene glycol, polypropylene glycol, or combinations thereof.

8. The food safe article of claim 1, wherein a concentration of the food safe water resistant material covering the substrate ranges from about 0.5 grams per square meter to about 10.0 grams per square meter of the substrate.

9. The food safe article of claim 1, wherein the food safe water resistant material has a moisture content less than 10% by weight based on the total weight of the food safe water resistant material.

10. The food safe article of claim 1, wherein the food safe water resistant material has a total polymer content of less than 85% by weight, based on the total weight of the food safe water resistant material.

11. The food safe article of claim 1, wherein the food safe water resistant material comprises a wax comprising a paraffin wax, a polypropylene-wax mixture, a polyethylene-wax mixture, carnauba wax, microcrystalline wax, montan wax, a Fisher-Tropsch wax, beeswax, or mixtures thereof.

12. The food safe article of claim 1, wherein the food safe article is a plate, bowl, fork, spoon, knife, straw, cup, cup lid, wrapper, liner, tray, box, container, or container lid.

13. The food safe article of claim 1, wherein the food safe article is a straw.

14. Use of a food safe article for consuming, serving, transporting, storing, or disposing of food wherein the food safe article comprises:

a paper substrate comprising a plurality of cellulose fibers; and a food safe water resistant material comprising an organo-silicon polymer, wherein the food safe water resistant material impregnantly covering at least a portion of a surface of the paper substrate thereby imparting a wet strength of at least 2,000 Newtons to the paper substrate.

15. The use of claim 14, wherein the food safe article is a plate, bowl, fork, spoon, knife, straw, cup, cup lid, wrapper, liner, tray, box, container, or container lid.

16. The use of claim 14, wherein the food safe article is a straw.

17. A method for preparing a food safe article, the method comprising:

i. providing a paper article comprising a plurality of cellulose fibers; and ii. contacting the article with a food safe water resistant composition thereby forming a food safe water resistant material comprising an organo-silicon polymer, wherein the food safe water resistant material impregnantly covering at least a portion of a surface of the paper article thereby imparting a wet strength of at least 2,000 Newtons to the paper article.

18. The method of claim 17, wherein the food safe article is a plate, bowl, fork, spoon, knife, straw, cup, cup lid, wrapper, liner, tray, box, container, or container lid.

* * * * *